US006388554B1

(12) United States Patent
Yamaguchi

(10) Patent No.: US 6,388,554 B1
(45) Date of Patent: May 14, 2002

(54) CIRCUIT BREAKER DEVICE

(75) Inventor: Noboru Yamaguchi, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/499,691

(22) Filed: Feb. 8, 2000

(30) Foreign Application Priority Data

Mar. 10, 1999 (JP) ..... 11-064068

(51) Int. Cl.[7] ..... H01H 37/76; H01H 85/055

(52) U.S. Cl. ..... 337/401; 337/157; 337/406; 337/408; 337/409; 361/115

(58) Field of Search ..... 337/157, 182, 337/401–409, 185; 307/9.1–10.8, 119; 180/271, 274, 279–283; 200/61.08; 361/115

(56) References Cited

U.S. PATENT DOCUMENTS 3,848,100 A * 11/1974 Kozorezov et al. ..... 200/61.08
3,873,786 A * 3/1975 Lagofun ..... 200/61.08
3,885,223 A * 5/1975 Green ..... 337/406
3,958,206 A * 5/1976 Klint ..... 337/406
4,150,266 A * 4/1979 Patrichi ..... 200/61.08
4,311,890 A * 1/1982 Schroder ..... 200/61.08
4,417,519 A * 11/1983 Lutz ..... 102/263
4,479,105 A * 10/1984 Banes ..... 337/4
4,489,301 A * 12/1984 Johnson et al. ..... 337/401
4,677,412 A * 6/1987 Sibalis ..... 337/401
5,360,999 A * 11/1994 Upshaw et al. ..... 307/112
5,831,507 A 11/1998 Kasamatsu et al.
6,243,245 B1 * 6/2001 Totsuka et al. ..... 361/103

FOREIGN PATENT DOCUMENTS

DE 4015230 A1 11/1990
DE 19735552 A1 1/1999

* cited by examiner

*Primary Examiner*—Leo P. Picard
*Assistant Examiner*—Anatoly Vortman
(74) *Attorney, Agent, or Firm*—Finnegan, Henderson, Farabow, Garrett & Dunner, L.L.P.

(57) ABSTRACT

A circuit breaker device including a first connection terminal, a second connection terminal, a heating portion electrically interconnecting the first connection terminal and the second connection terminal, and a claw lockingly engaged with the heating portion. The claw is configured to be melted by the heating portion to allow the heating portion to move apart from the first connection terminal and the second connection terminal for electrical disconnection.

15 Claims, 8 Drawing Sheets

CIRCUIT BREAKER DEVICE

BACKGROUND OF THE INVENTION

1. Field of the Invention

The present invention relates to a circuit breaker device that breaks an electric circuit in a short time.

2. Description of the Related Art

In an electric equipment system provided on a vehicle, a large current fuse that has been disposed between the battery and the wire harness is cut off by fusion when some abnormality or other has occurred, for example, in a load, such as a power window, or in a wire harness constructed of a plurality of electric wires connecting a battery and each load, etc. By doing so, a break is made between the battery and the wire harness to thereby prevent the respective loads or wire harness from being damaged by burning.

However, in such an electric equipment system using a large current fuse, even when some abnormality or other has occurred in a load, such as a power window, or in a wire harness constructed of a plurality of electric wires connecting a battery and each load, etc., the large current fuse is not cut off by fusion unless an electric current of a magnitude greater than a permissible value that is preset in the large current fuse occurs. In this view, there have been developed protection apparatuses of bi-metal type and fusible conductor type that sense this flowage and makes a break between the battery and the wire harness when a large current of a magnitude near the permissible value is continuously flowing therethrough.

SUMMARY OF THE INVENTION.

However, in the protection apparatus of bi-metal type, using a bi-metal, wherein two kinds of metal whose coefficients of thermal expansion differ from each other, it is detected whether a large current is flowing through a fusible member. Therefore, when the magnitude of the current flowing through the fusible member is changed, the bi-metal is deformed with the result that the length of time that is needed until the breakage of the circuit changes.

For this reason, when a trouble has occurred, such as that wherein a large magnitude of current intermittently flows, it happens that the temperature of the fusible member ceases to rise beyond a certain value of temperature. As a result, there was the possibility that the wire harness or the load excessively generated heat before the protection apparatus broke the circuit.

On the other hand, in the protection apparatus of fusible conductor type, using a coil made of a shape memory alloy, it is detected whether a large magnitude of current is flowing through the fusible conductor line. Therefore, when the magnitude of the current flowing through the fusible conductor line is changed, the coil is deformed, with the result that the length of time that is needed until the breakage of the circuit changes.

For this reason, when a large magnitude of current intermittently flows, it happens that the temperature of the fusible conductor line ceases to rise beyond a certain value of temperature. As a result, there was the possibility that the wire harness or the load excessively generated heat before the protection apparatus broke the circuit. Also, in a case where using bi-metal or shape memory alloy, the temperature at which the deformation starts is ordinarily as low as approximately 100° C. Therefore, bi-metal or shape memory alloy was difficult to use at a temperatures of 120° C. to 125° C., which is the environmental-of-use conditions of a vehicle.

Also, in both protection apparatuses, the response-to-heat length of time of the bi-metal or coil, which is a heat-deformable electricity conductor member, was influenced by the passage of current through it. Furthermore, there were cases where at the time of an abnormality (the passage of current in excess) the response to heat of the heat-deformable electricity conductor member did not occur timely.

An object of the present invention is to provide a circuit breaker device that when an abnormality signal on the vehicle can break the circuit shortly and reliably, and protect a relevant electric circuit.

To achieve the above object, the present invention provides a circuit breaker device. The device has a first connection terminal; a heating portion which is filled with a heating agent and has a conductivity; and a first contact member for conductively joining the heating portion to the first connection terminal. The first contact member has contact portions and opening portions.

Preferably, each of the opening portions is a slit portion which consists of a slender groove.

Preferably, each of the contact portions and the slit portions are alternately formed.

Preferably, the first contact member is mounted to the first connection terminal, and the contact portions are brought in contact with the heating portion.

Preferably, the-first contact member is mounted to the eating portion, and the contact portions are brought in contact with the first connection terminal.

Preferably, the device further has a second connection terminal; and a second contact member for conductively joining the heating portion to the second connection terminal. The second contact member has contact portions and opening portions.

Preferably, the device further has a claw portion which is lockingly engaged with the heating portion.

Preferably, the claw portion is made of resin.

Preferably, the device further has an outer vessel which is fixed with the claw portion. The outer vessel accommodates the heating portion.

Preferably, the device further has an elastic member which is arranged to contact with the heating portion. The elastic member is for biasing the heating portion to the claw portion.

Preferably, the device further has an ignition portion for igniting the heating agent by an abnormal signal from outside at abnormality of a vehicle.

Preferably, the outer vessel has an upper casing and a lower casing. The upper casing is formed with a first threaded portion. The lower portion is formed with a second threaded portion which is screwed to the first threaded portion.

Preferably, the device further has an outer vessel which accommodates the heating portion. The first connection terminal is integrally formed to the outer vessel.

Preferably, the device further has an out vessel which accommodates the heating portion. The second connection terminal is integrally formed to the outer vessel.

Preferably, the heating agent is a thermit agent which has a metal oxide powder and an aluminum powder mixed with the metal oxide powder.

According to the present invention, for example, a first connection terminal or a second connection terminal is connected to a heating portion via a first or second contact member, whereby a power is supplied from a battery to a load. Also, when an ignition portion gets ignited due to an abnormality signal from outside, a heating agent filled in the heating portion generates heat, whereby due to this heat, claw portions, each formed on an outer vessel and made of resin material, are melted. For this reason, an elastic member is expanded with the result that the heating portion is pushed upward while sliding on the first or second contact member. Therefore, the electric connection between the heating portion and one of the first and the second connection terminals is cut off. Therefore, it is possible to cut off the circuit shortly and reliably and to thereby protect relevant electric parts.

Also, since the first or second contact member is a multi-contact spring, and wherein slit portions consisting of a slender groove and contact portions electrically contacted with the heating portion are formed alternately two or more in number, the resistance to sliding is small. Therefore, it is possible to easily cut off the circuit and, in addition, since the resistance to contact is small, it is possible to lessen the generation of heat when a large current passes through.

Also, when an upper casing is fitted onto a lower casing, a first threaded portion formed on the upper casing is screwed onto a second threaded portion formed on the lower casing. As a result, when breakage of the circuit is done, the heating portion ceases to pop out, nor is there a fear that a relevant person will be scorched due to the heat.

Also, since the first or the second connection terminal is formed integrally with the outer vessel, only a small number of parts items to be assembled are needed, with the result that the number of operation steps can be reduced.

Also, the heating agent can generate a heat of thermit reaction due to the thermit reaction.

BRIEF DESCRIPTION OF THE ACCOMPANYING DRAWINGS

DETAILED DESCRIPTION OF THE PREFERRED EMBODIMENTS

Embodiments of a circuit breaker according to the present invention will now be explained in detail with reference to the drawings.

First Embodiment

The circuit breaker according to the embodiment is characterized in that, using multi-contact springs, upon an input to it of an abnormality signal on a vehicle the circuit can be reliably broken in a short time to thereby protect relevant electric parts.

Figure 1:
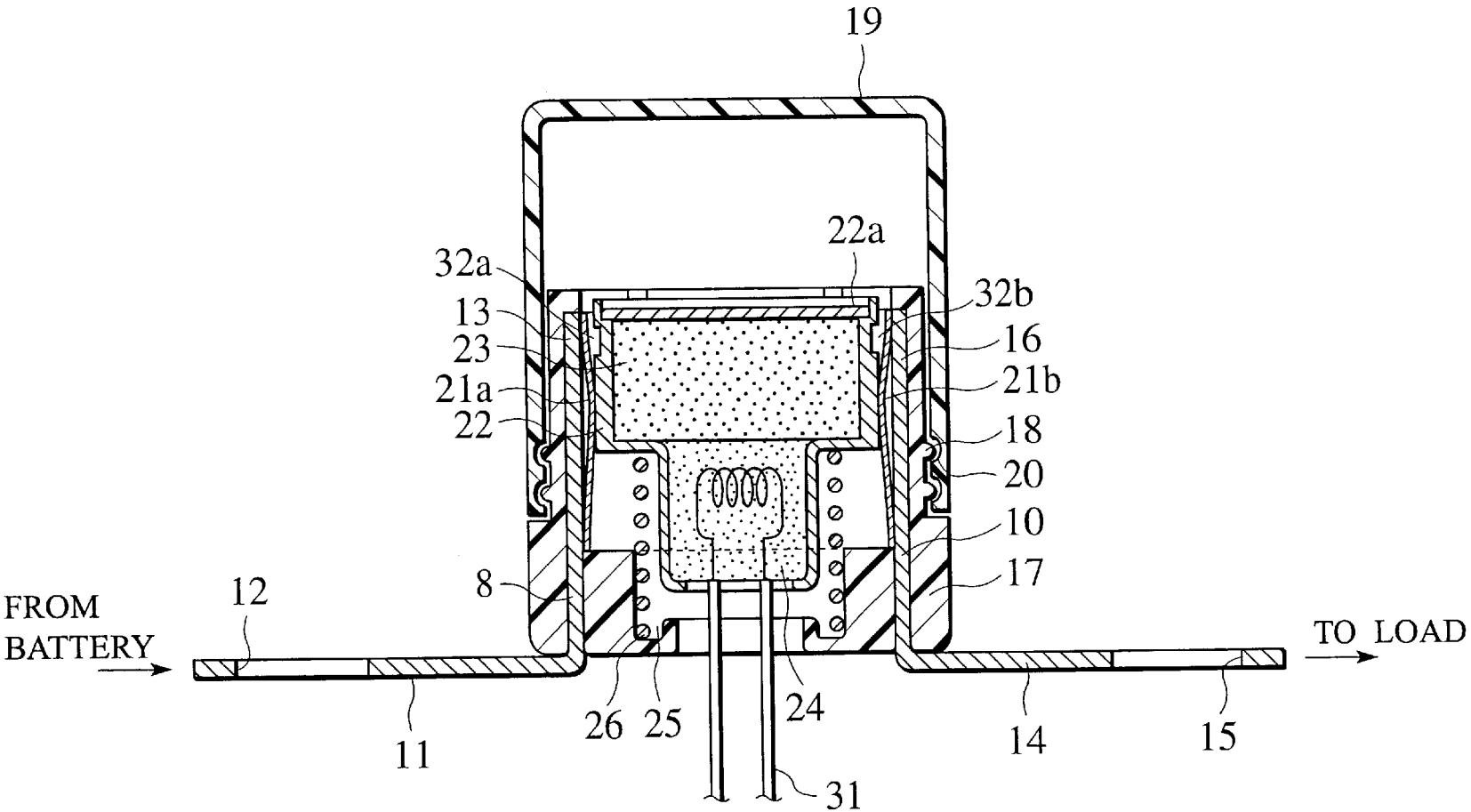
FIG. 1 is a sectional view taken along a line A1—A1 of a circuit breaker according to a first embodiment of the present invention before the circuit is broken.

In the circuit breaker illustrated in FIG. 1, a plate-like long first bus bar 11, a first connection terminal, consists of, for example, copper or a copper alloy. This first bus bar 11 has formed therein a round hole portion 12 connected to a battery, etc. The first bus bar 11 has formed thereon a bent portion 8 that has been bent at a substantially right angle. And this bent portion 8 and a forward end portion 13 of the bus bar are inserted into a resin casing 17, or a lower casing, by integral forming (insert molding).

Also, a plate-like long second bus bar 14, a second connection terminal, consists of, for example, copper or a copper alloy. This second bus bar 14 has formed therein a round hole portion 15 connected to a load, etc. The second bus bar 14 has formed thereon a bent portion 10 that has been bent at a substantially right angle. And this bent portion 10 and a forward end portion 16 of the bus bar are inserted into the resin casing 17 by integral forming (insert molding).

Between the first bus bar 11 and the second bus bar 14 are disposed the resin casing 17 and a cap 19, or an upper casing. The cap 19 is made to cover the resin casing 17. The cap 19 and the resin casing 17 constitutes an outer vessel, which consists of a vessel made of insulating material such as resin (thermoplastic resin).

Within the resin casing 17 is accommodated a heating agent casing 22 that consists of copper and a copper alloy. This heating agent casing 22 is filled with a heating agent 23, and in this heating agent casing 22 there is accommodated an ignition portion 24.

The ignition portion 24 has an ignition agent. It is arranged to cause the ignition of the ignition agent by the heat generated due to the electric current that, at the time of an abnormality of the vehicle, such as, a collision accident or the like of the vehicle, flows into a lead wire 31. This ignition causes the generation of a heat of thermit reaction in the heating agent 23.

Figure 2:
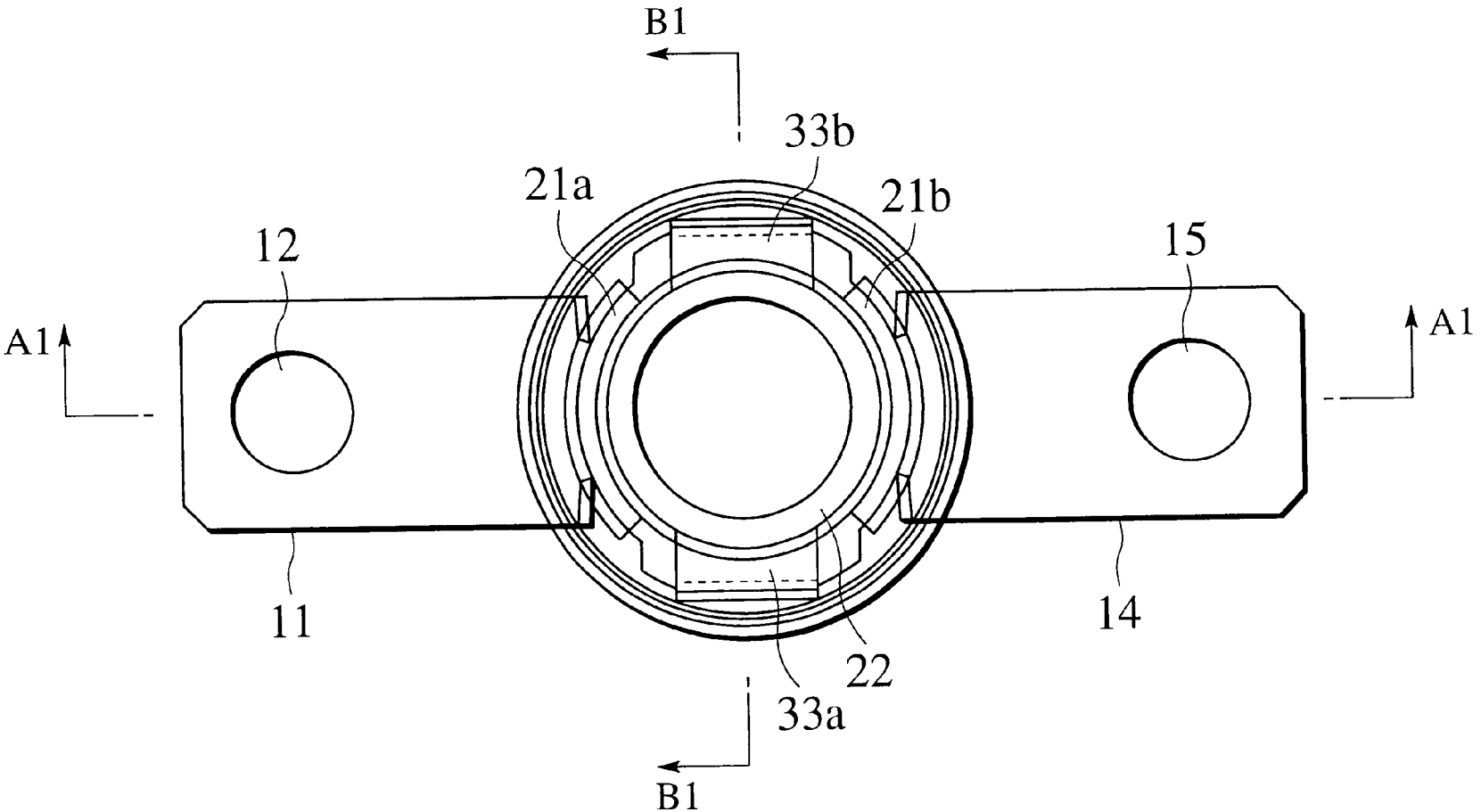
FIG. 2 is an upper surface view illustrating the circuit breaker according to the embodiment.

On the bus bar forward end 13 is mounted a multi-contact spring 21*a*, a first contact member, with a conductivity. Also, on the bus bar forward end portion 16 there is mounted a multi-contact spring 21*b*, a second contact member, with a conductivity. The multi-contact spring 21*a* and the multi-contact spring 21*b* are disposed opposing each other and in such a way as to clamp a side wall portion of the heating agent casing 22, as illustrated in FIGS. 1 and 2. For this reason, the first bust bar 11 and the second bus bar 14 can be electrically connected to each other via the multi-contact springs 21*a*, 21*b* and the heating agent casing 22. Each of the multi contact springs may be multiple leafed springs as shown in FIG. 4.

Figure 4:
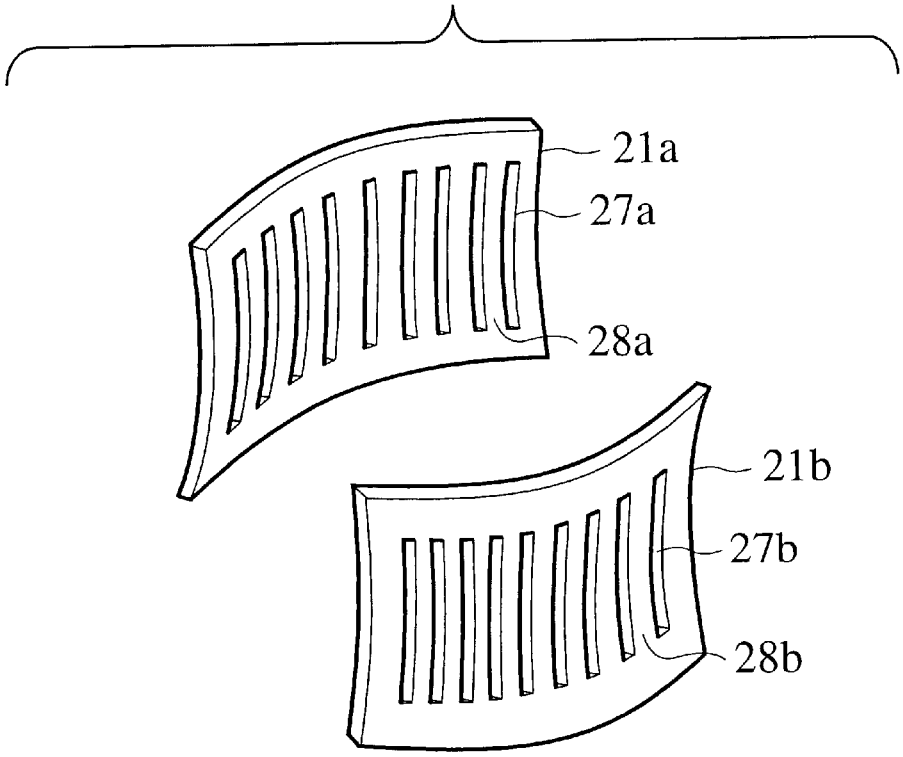
FIG. 4 is a constructional view illustrating a multi-contact spring.

As illustrated in FIG. 4, each of the multi-contact springs 21*a*, 21*b*, when viewed from an upper surface side and a side surface side, is shaped like a circular arc. Each of the multi-contact springs 21*a*, 21*b* has a construction wherein a slit portion 27*a*, 27*b*, consisting of a slender groove, and a contact portion 28*a*, 28*b*, electrically contacted with the heating agent casing 22, are each alternately formed two or more in number.

Here, with reference to FIGS. 5 to 8, the advantages of the multi-contact springs will now be explained in detail by comparing the characteristic of a multi-spring socket and that of a slot contact socket, both sockets using the multi-contact springs.

Figure 5:
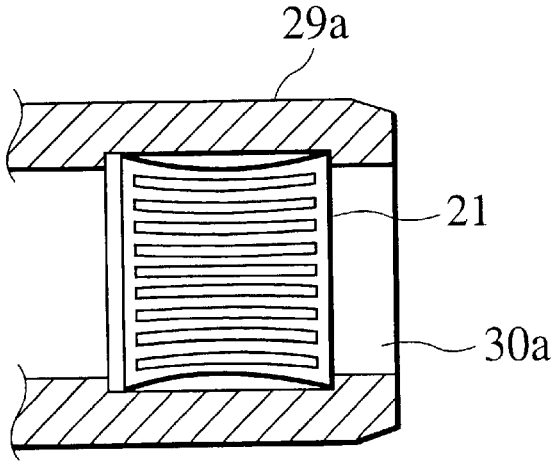
FIG. 5 is a structural view illustrating a multi-contact socket.

As illustrated in FIG. 5, the multi-contact socket using the multi-contact spring has a socket main body 29*a* having an opening portion 30*a*. The multi-contact spring 21 is disposed within the opening 30*a* and forms a circle when viewed from the opening portion side. As a result of this, by a pin, not illustrated, being inserted into the multi-contact spring 21 via the opening portion 30*a*, the pin and the multi-contact socket are electrically connected together.

Figure 6:
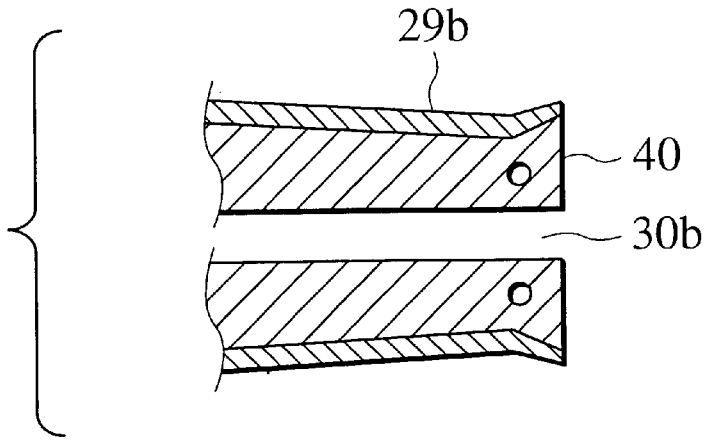
FIG. 6 is a structural view illustrating a slot contact socket.

As illustrated in FIG. 6, the slot contact socket has a socket main body 29*b* having an opening portion 30*b* and a tapered slot contact portion 40 disposed within the socket main body 29*b*. As a result of this, by a pin, not illustrated, being inserted into a slot contact portion 40 via the opening portion 30*b*, the pin and the slot contact socket are connected together.

Figure 7:
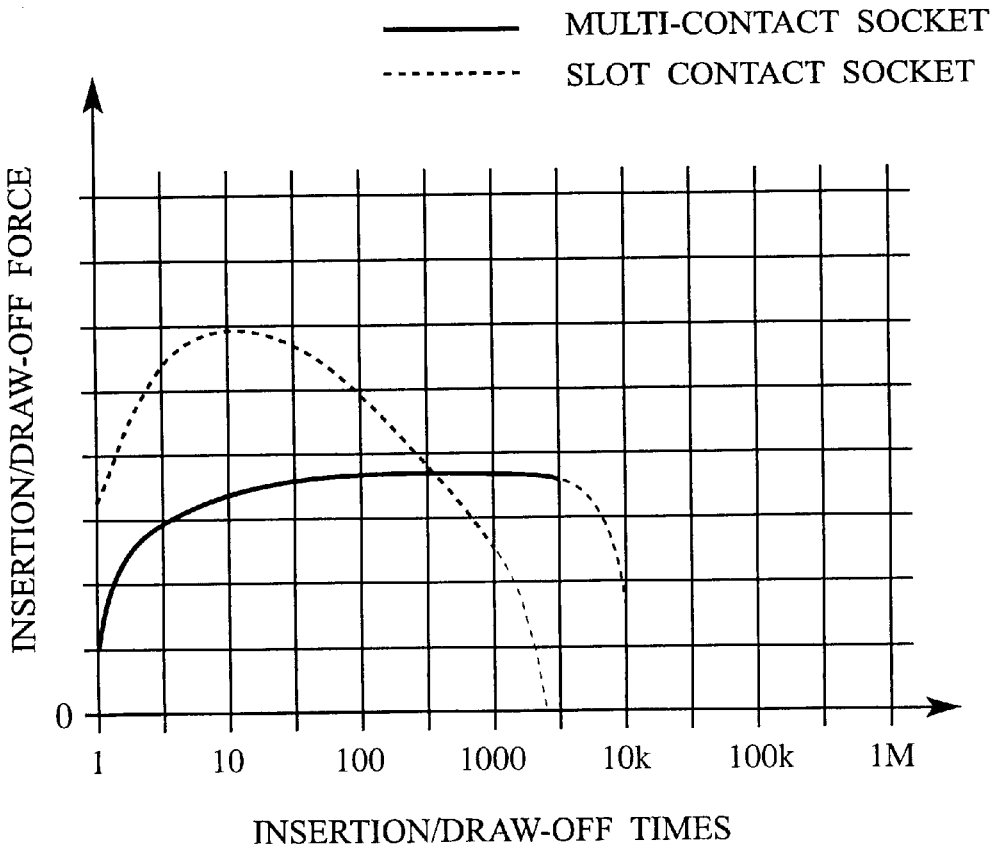
FIG. 7 is a characteristic diagram illustrating the insert/draw-off forces of a multi-contact socket and a slot contact socket.

FIG. 7 illustrates the results of comparison that is made between the slot contact socket (indicated in a dotted line in FIG. 7) and the multi-contact spring socket (indicated in a solid line in FIG. 7) in terms of the insertion force acting when the pin is inserted into the socket and the draw-off force acting when the pin is drawn off from the socket (in FIG. 7 the insertion force and draw-off forces have been called "an insert/draw-off force" as abbreviated). It is easily seen from FIG. 7 that the multi-contact spring socket is smaller.

Figure 8:
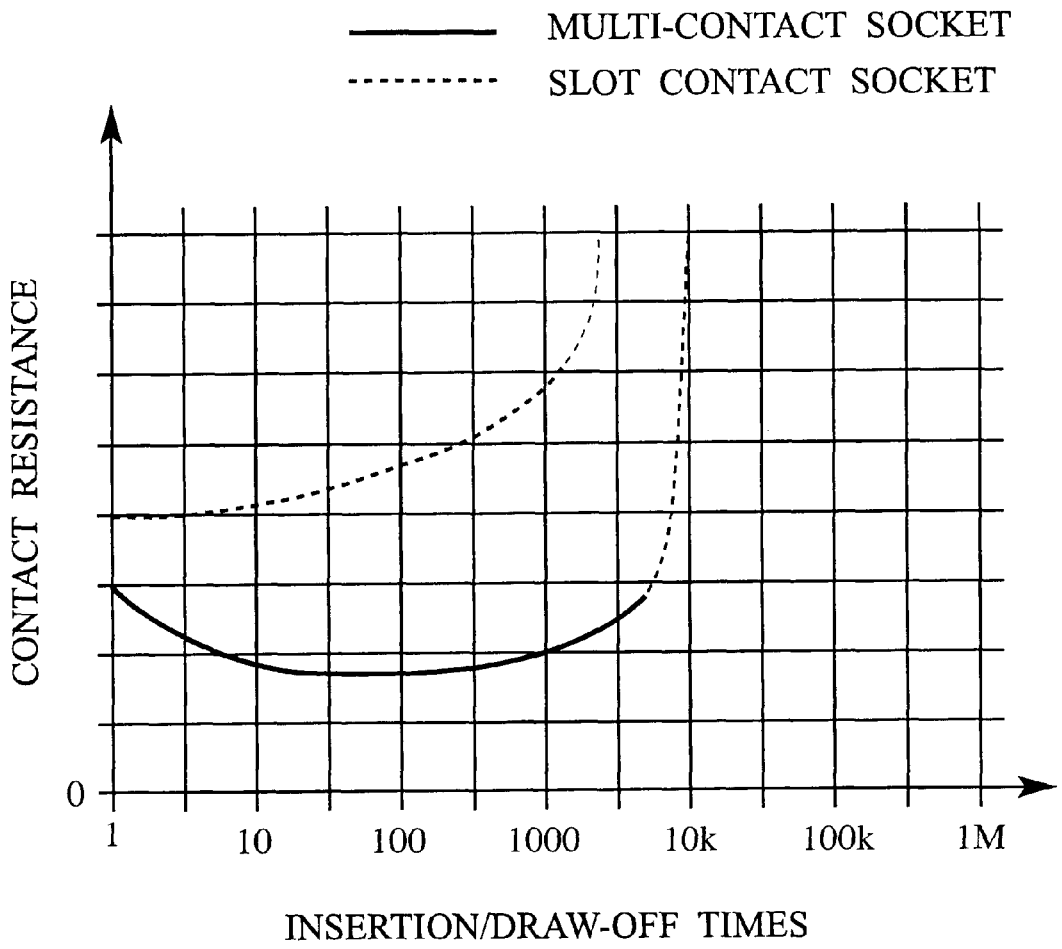
FIG. 8 is a diagram illustrating the resistance to contact of the multi-contact socket and that of the slot contact socket.

FIG. 8 illustrates the results of comparison that is made between the slot contact socket (indicated in a dotted line in FIG. 8) and the multi-contact spring socket (indicated in a solid line in FIG. 8) in terms of the contact resistance that is produced when the pin is inserted into the socket. It is easily seen from FIG. 8 that the multi-contact spring socket is smaller in terms of the contact resistance. Namely, the multi-contact spring is smaller both in terms of the contact resistance and in terms of the insert/draw-off force.

The heating agent 23 is a thermit agent that is composed of, for example, a metal oxide powder such as iron oxide ($Fe_2O_3$) and aluminum powder and makes a thermit reaction due to the heat generated from a lead wire 31 to thereby generate a high-temperature heat. It is to be noted that instead of using iron oxide ($Fe_2O_3$) there may be used chromium ($Cr_2O_3$), manganese oxide ($MnO_2$), etc.

Also, as the heating agent 23, there may be used a mixture of metal powder of one kind selected from the group consisting of B, Sn, FeSi, Zr, Ti, and Al, metal oxide of one kind selected from the group consisting of CuO, $MnO_2$, $Pb_3O_4$, $PbO_2$, $Fe_3O_4$, and $Fe_2O_3$, and at least one kind of additive including alumina, bentonite, talc, etc.

Also, a compression spring 26, or an elastic member, is disposed as an expansible and contractible elastic member between the heating agent casing 22 and groove portions 25 formed in the resin casing 17. This compression spring 26 presses the heating agent casing 22 upward.

Also, the resin casing 17 has formed therein a concavities/convexities-like threaded portion 18 while the cap 19 has formed therein a concavities/convexities-like cap threaded portion 20. It is thereby arranged that when the cap 19 has been mounted onto the resin casing 17, the cap threaded portion 20 and the casing threaded portion 18 are screwed to each other.

Further, a groove portion 32 is formed in the form of a strip over an entire circumference of the heating agent casing 22. Protrusion-like pawl portions 33*a*, 33*b*, a claw portion to be lockingly engaged, are formed on a forward end portion of the resin casing 17. The pawl portions 33*a*, 33*b* formed on the resin casing 17 are engaged with groove portions 32*a*, 32*b*. These pawl portions 33*a*, 33*b* are arranged to stop the upward movement of the heating agent casing 22 due to the spring force of the compression spring 26.

Next, the operation of the circuit breaker according to the embodiment, which has been constructed as described above, will be explained with reference to the drawings.

Figure 3:
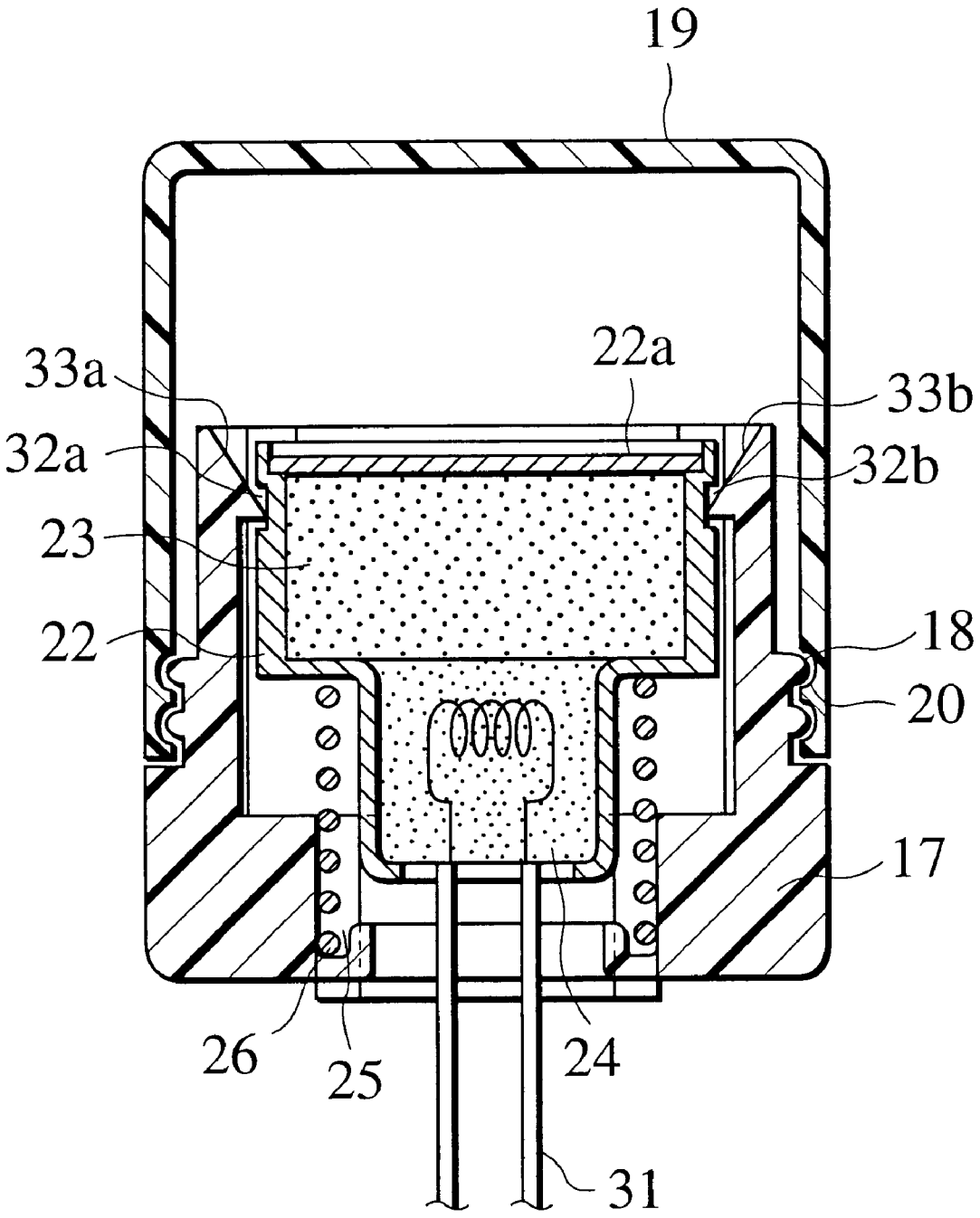
FIG. 3 is a sectional view taken along a line B1—B1 of the circuit breaker according to the embodiment.

First, in FIGS. 1 and 3, ordinarily, the first bus bar 11 and the second bus bar 14 are electrically connected to each other via the multi-contact springs 21*a*, 21*b* and the heating agent casing 22, whereby an electric current is supplied from a battery, not illustrated, to a load, not illustrated.

Next, when the vehicle collides with an obstacle or the like, or when the vehicle falls from a cliff or the like, an abnormality of the vehicle is sensed by a collision sensor, etc. By the sensing of the vehicle abnormality, an electric current flows into the ignition portion 24 through the lead wire 31.

Then, the ignition portion 24 gets ignited due to the generation of heat due to the electric current. As a result, the heating agent 23, which is a thermit agent, generates the heat of thermit reaction in accordance with the following reaction formula.

$$Fe_2O_3+2AL \rightarrow Al_2O_3+2Fe+386.2\ Kcal$$

Due to the heat of thermit reaction, the heating agent casing 22 is heated. Therefore, due to the generation of heat in the heating agent 23 and to the heat of the heating agent casing 22, the pawl portions 33*a*, 33*b* that are in engagement with the groove portion 32 are heated to be melted.

Figure 9:
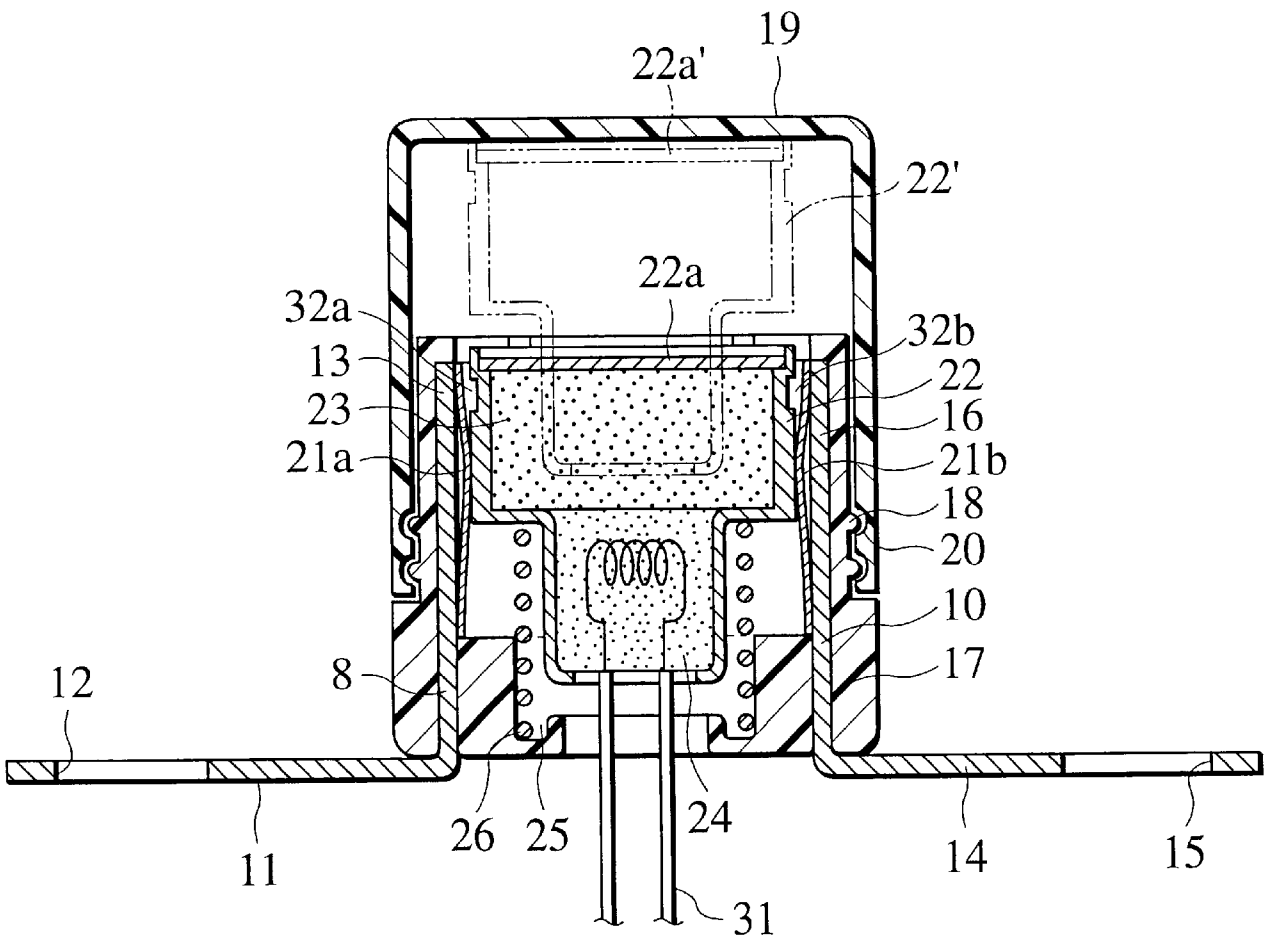
FIG. 9 is a sectional view taken along a line A1—A1 of the circuit breaker according to the embodiment after the circuit has been broken.

As a result, as shown in FIG. 9, the compression spring 26 that has theretofore been compressed is expanded. As a result, while being slid on the multi-contact springs 21*a*, 21*b*, the heating agent casing 22 having accommodated therein the ignition portion 24 is sprung up (in FIG. 9 a reference symbol 22' represents the heating agent casing after it has been moved upward).

For this reason, the electrical connection between the heating agent casing 22 and the first bus bar 11 and the second bus bar 14 is rendered ineffective. Namely, it results that the first bus bar 11 and the second bus bar 14 are electrically out off, whereby the electric circuit of the vehicle is broken.

In this way, according to the circuit breaker of the embodiment, since each of the multi-contact springs 21*a*, 21*b* has a small resistance to contact, even when a large current passes therethrough, it is possible to lessen the generation of heat. Also, since the insert/draw-off forces thereof are small, even when the heating agent casing 22 is moved vertically, the heating agent casing 22 can easily rise due to a small sliding resistance of the multi-contact springs.

Namely, because of the sliding resistance of each multi-contact spring 21*a*, 21*b*, the electric circuit of the vehicle can be broken reliably in a short time to make it possible to protect the relevant electric parts. Further, because of the use of the thermit reaction heat of the heating agent 23, it is possible to provide the circuit breaker with a simple structure.

Also, because the external stress that has been applied to the first bus bar 11 and the second bus bar 14 can be absorbed by the multi-contact springs 21*a*, 21*b*, the external stress ceases to be applied to the heating agent casing 22. As a result of this, it is possible to enhance the reliability of the circuit breaker. Also, because of the use of the compression spring 26, the circuit breaker becomes inexpensive, easy to design, and assemble.

Further, because the first bus bar 11 and the second bus bar 14 are being separated from the heating agent casing 22, it is possible to enhance the assembling efficiency. Also, if insert molding the first bus bar 11 and the second bus bar 14 into the resin casing 17, the number of assembling parts can be made smaller and the number of operational steps can be decreased. Also, since the cap 19 is fitted over the resin casing 17, it does not happen that when the circuit is broken the heating agent casing 22 will be popped out. Also, there ceases to exist the possibility of a relevant person getting scorched, etc., due to the heat.

Second Embodiment

Figure 10:
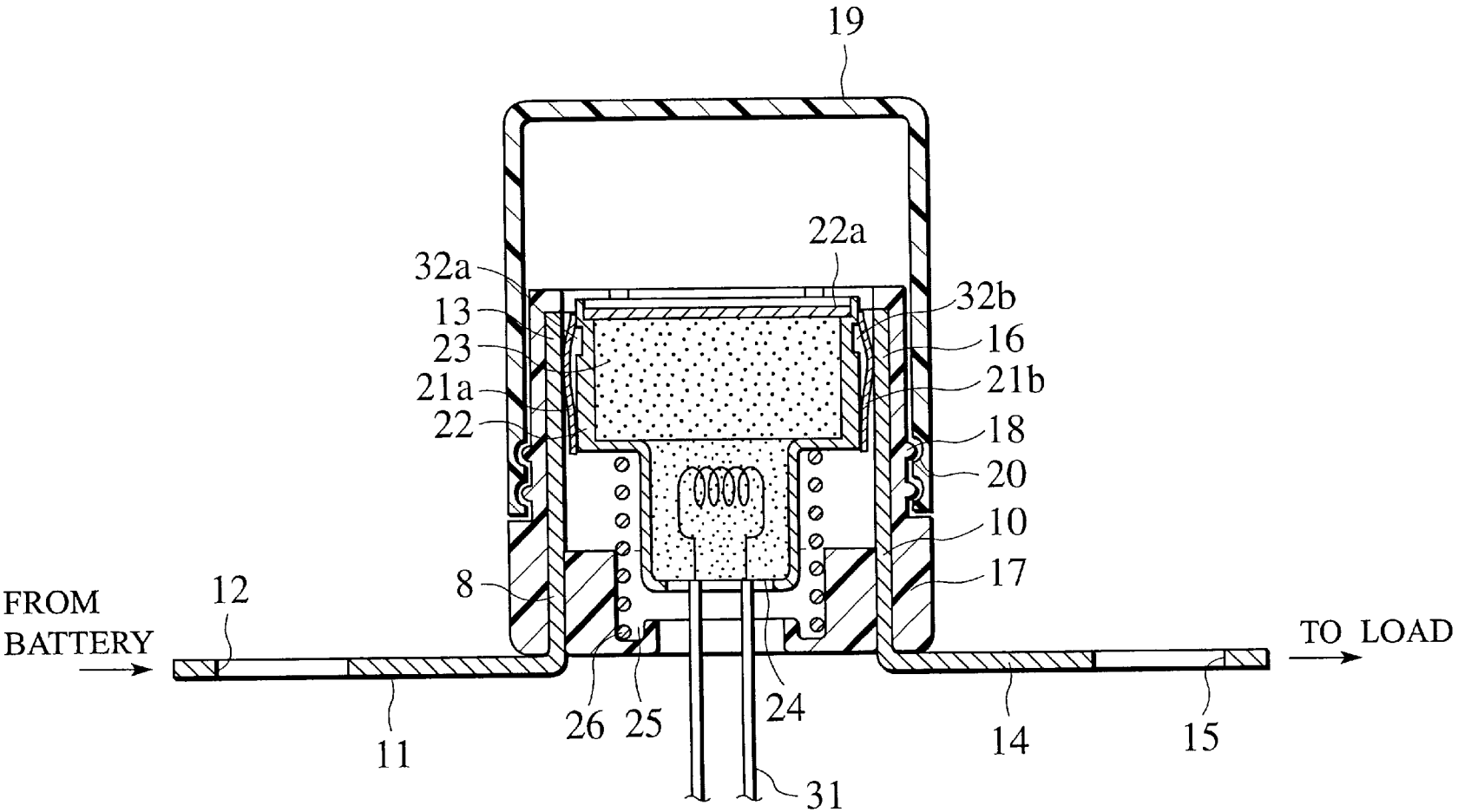
FIG. 10 is a sectional view illustrating a circuit breaker according to a second embodiment.

FIG. 10 illustrates a section of the circuit breaker according to a second embodiment.

In this embodiment, instead of mounting the multi-contact springs 21*a*, 21*b* onto the bus bar forward end portions 13, 16, multi-contact springs 21*c*, 21*d* are mounted onto the heating agent casing 22, for example. Further, alternatively, it may be arranged that one of the multi-contact springs 21*c*, 21*d* is mounted on a relevant one of the bus bar forward end portion 13, 16 while the other thereof is mounted on the heating agent casing 22.

The present invention is not limited to the above described embodiment and modification. For example, regarding the multi-contact springs 21*a*, 21*b*, only either one of them may be used. Also, the configuration of the multi-contact spring 21*a*, 21*b* is not limited to a circular arc configuration but may be triangular, square, or other configuration. Further, the width of the contact point portion 28*a*, 28*b*, or the width of the slit portion 27*a*, 27*b* may be suitably selected. The direction of the slit portion 27*a*, 27*b* is not limited to the width direction but may be longitudinal or diagonal. The configuration of the slit portion 27*a*, 27*b* may be circular, an elliptic, triangular, polygonal, or other configuration. Regarding the pawl portions 33*a*, 33*b*, only either one of them may be used. Also, the resin-made pawl portion may be fixed to the heating agent casing 22 and a groove may be formed in each of the first bus bar 11 and second bus bar 14.

What is claimed is:

1. A circuit breaker device comprising:

a first connection terminal;

a second connection terminal;

a heating portion electrically interconnecting the first connection terminal and the second connection terminal, the heating portion normally being biased; and a meltable claw locked with the heating portion, wherein the claw is configured to be melted by the heating portion to disengage from the heating portion to allow the biased heating portion to move apart from the first connection terminal and the second connection terminal for electrical disconnection.

2. A circuit breaker device according to claim 1, further comprising:

a first contact member electrically interconnecting the first connection terminal and the heating portion.

3. A circuit breaker device according to claim 2, wherein the first contact member comprises a multiple leaf spring including contact portions and slit portions, wherein the contact portions and slit portions are each alternately formed.

4. A circuit breaker device according to claim 3, wherein the first contact member is mounted to the first connection terminal, and the contact portions are brought into electrical contact with the heating portion.

5. A circuit breaker device according to claim 3, wherein the first contact member is mounted to the heating portion, and the contact portions are brought into electrical contact with the first connection terminal.

6. A circuit breaker device according to claim 1, further comprising:

a second contact member electrically interconnecting the heating portion and the second connection terminal.

7. A circuit breaker device according to claim 1, wherein the claw is made of resin.

8. A circuit breaker device according to claim 1, further comprising:

an outer vessel fixed with the claw, the outer vessel accommodating the heating portion.

9. A circuit breaker device according to claim 1, further comprising:

a resilient member biasing the heating portion.

10. A circuit breaker device according to claim 1, further comprising:

a heating agent filling the heating portion; and an ignition portion for igniting the heating agent by an abnormal signal from a remote location.

11. A circuit breaker device according to claim 8, wherein the outer vessel has an upper casing and a lower casing, the upper casing is formed with a first threaded portion, and the lower portion is formed with a second threaded portion screwed to the first threaded portion.

12. A circuit breaker device according to claim 8, wherein the first connection terminal is integrally formed to the outer vessel.

13. A circuit breaker device according to claim 8, wherein the second connection terminal is integrally formed to the outer vessel.

14. A circuit breaker device according to claim 1, wherein the heating portion includes a thermit agent including a metal oxide powder and an aluminum powder mixed with each other.

15. A circuit breaker device according to claim 1, wherein the second contact member is a multiple leaf spring including contact portions and slit portions each alternately formed.

* * * * *